United States Patent [19]

Pogonowski et al.

[11] 3,955,372

[45] May 11, 1976

[54] METHOD OF INSTALLING A FIXED MARINE PLATFORM WITH DISPERSED BASE

[75] Inventors: Ivo C. Pogonowski, Blacksburg, Va.; Paul D. Carmichael, Houston, Tex.

[73] Assignee: Texaco Inc., New York, N.Y.

[22] Filed: Dec. 30, 1974

[21] Appl. No.: 537,161

Related U.S. Application Data

[62] Division of Ser. No. 390,805, Aug. 23, 1973.

[52] U.S. Cl. ..... 61/46; 61/1 R

[51] Int. Cl.[2] ..... E02D 21/00

[58] Field of Search ..... 61/46, 46.5, 50, 53.6, 61/1, 37

[56] References Cited

UNITED STATES PATENTS 3,314,239 4/1967 Baron et al. ..... 61/46

3,662,559 5/1972 Swift ..... 61/46

*Primary Examiner*—Jacob Shapiro

*Attorney, Agent, or Firm*—T. H. Whaley; C. G. Ries; Robert B. Burns

[57] ABSTRACT

A method for fixedly positioned marine platform held at the ocean floor by piles and the like, having a relatively flat concrete apron disposed about the platform lower end and also supported on the ocean floor. The apron functions to stabilize the platform against lateral forces caused by water and wave motion, and also avoids scouring which would otherwise occur about the platform legs and piles due to movement of water along the ocean floor. The apron further lowers the center of gravity of the structure and improves its resistance to vibrations and resonance effects due to wave motion.

2 Claims, 5 Drawing Figures

FIG. 3
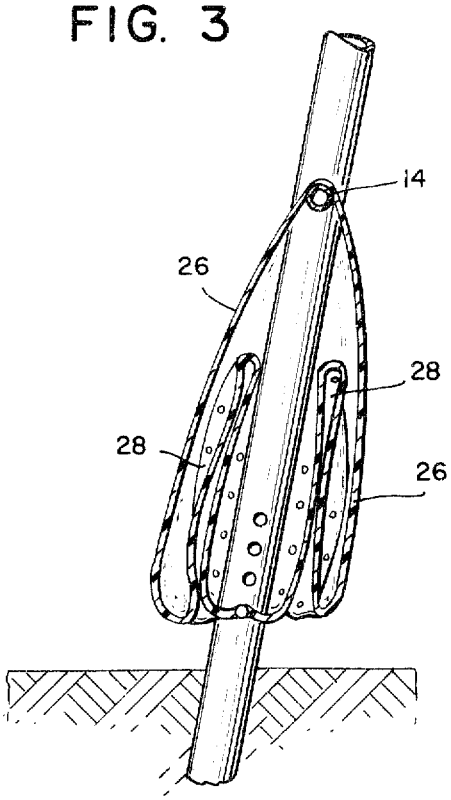
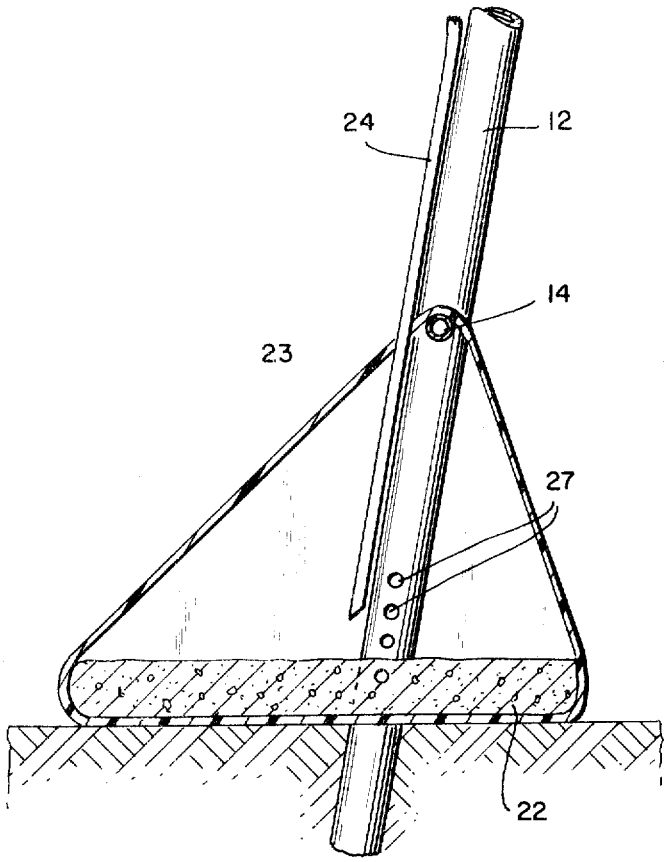
FIG. 4
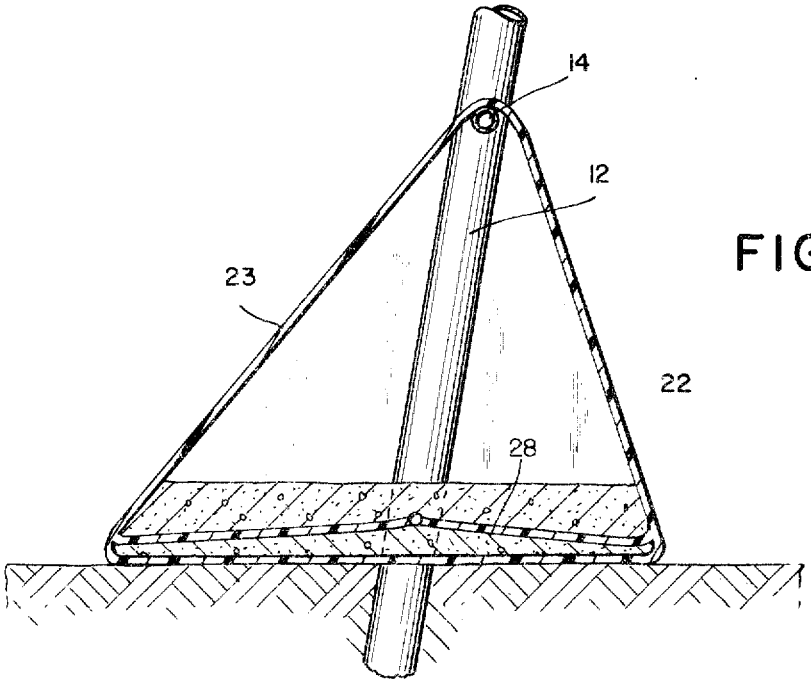
FIG. 5

METHOD OF INSTALLING A FIXED MARINE PLATFORM WITH DISPERSED BASE

This is a division of application Ser. No. 390,805, filed Aug. 23, 1973.

BACKGROUND OF THE INVENTION

In the use of offshore marine platforms which are fixedly positioned to the sea floor by pilings and the like, the problem of moving water and ocean currents can be troublesome in several ways. For one thing, constantly changing sea conditions can affect excessive periodic waves and water currents which could in turn set up harmful harmonics in the platform movement.

Further, in deeper offshore waters it is usually necessary to provide considerable weight at the platform lower end. This is to stabilize it more firmly against the above noted wind and wave conditions as well as to provide balance to the greater amount of steel necessitated in such deep water structures.

In the instance of any offshore platform however, a primary problem is the one caused by movement of water about the platform anchored or lower end. In virtually any location there will be a certain amount of water flow due to prevailing currents, to tide variations, and to other natural phenomena. In the instance of the firmly positioned or piled platform this water movement can be particularly harmful where the water tends to scour away the soil beneath the platform. Such action will tend to expose a greater length of the pile as well as a portion of the anchoring legs.

The stated problem has been particularly accentuated in the instance of platforms where the bottom structure is supplemented by tanks, storage facilities, templates or other sub-structures which would, by their presence, tend to alter the normal course of the flowing water. For example, where a storage facility has been incorporated into the platform lower end, water diverted through the platform legs has been found to scour a sufficient quantity of the ocean floor away from the anchoring piles and legs to jeopardize the stability of the structure.

In the arrangement of the marine structure presently contemplated, the lower end of the platform adjacent the ocean floor is provided with a relatively heavy apron or substantially horizontal skirt. A primary function of this apron, as it will be hereinafter referred to, is to engage the lower end of the platform to provide an additional weight factor thereby stabilizing the overall structure.

Since the apron is disposed adjacent to and about the respective legs of the platform, it in effect prohibits the scouring effect of ocean currents which would otherwise tend to erode away the sand and substrate and form shallow pits about the leg and anchoring piles.

The apron is formed preferably by pouring or depositing fluidized concrete or cement from a source above the water's surface, to the ocean floor. The concrete is initially retained within a flexible walled container which defines a partial enclosure about the fluidized material. The character of the flexible retainer is such that it will permit the fluidized material to normally flow about the platform legs, and yet maintain a desired depth. Thereafter, as the concrete hardens it will form a rigid yet widespread base or foundation. The flexible retainer can then be removed if feasible, or merely be permitted to wear away in the course of time such that only the concrete apron remains.

DESCRIPTION OF THE DRAWINGS

FIG. 3 is a sectional view taken along line 3—3 of FIG. 2.

FIG. 4 is similar to FIG. 3, showing the flexible container in expanded condition, and FIG. 5 is similar to FIG. 4 showing a reinforcing member in the apron section.

Referring to FIG. 1, a characteristic marine structure 10 of the type proposed, includes a plurality of substantially vertically disposed support legs or columns 11, 12 and 13. These legs are shown as canted slightly inward at the top toward the structure's central axis. The canting, however, is normally for the purpose of providing a greater area of distribution at the lower end of the platform, thus contributing to its stability.

Figure 1:
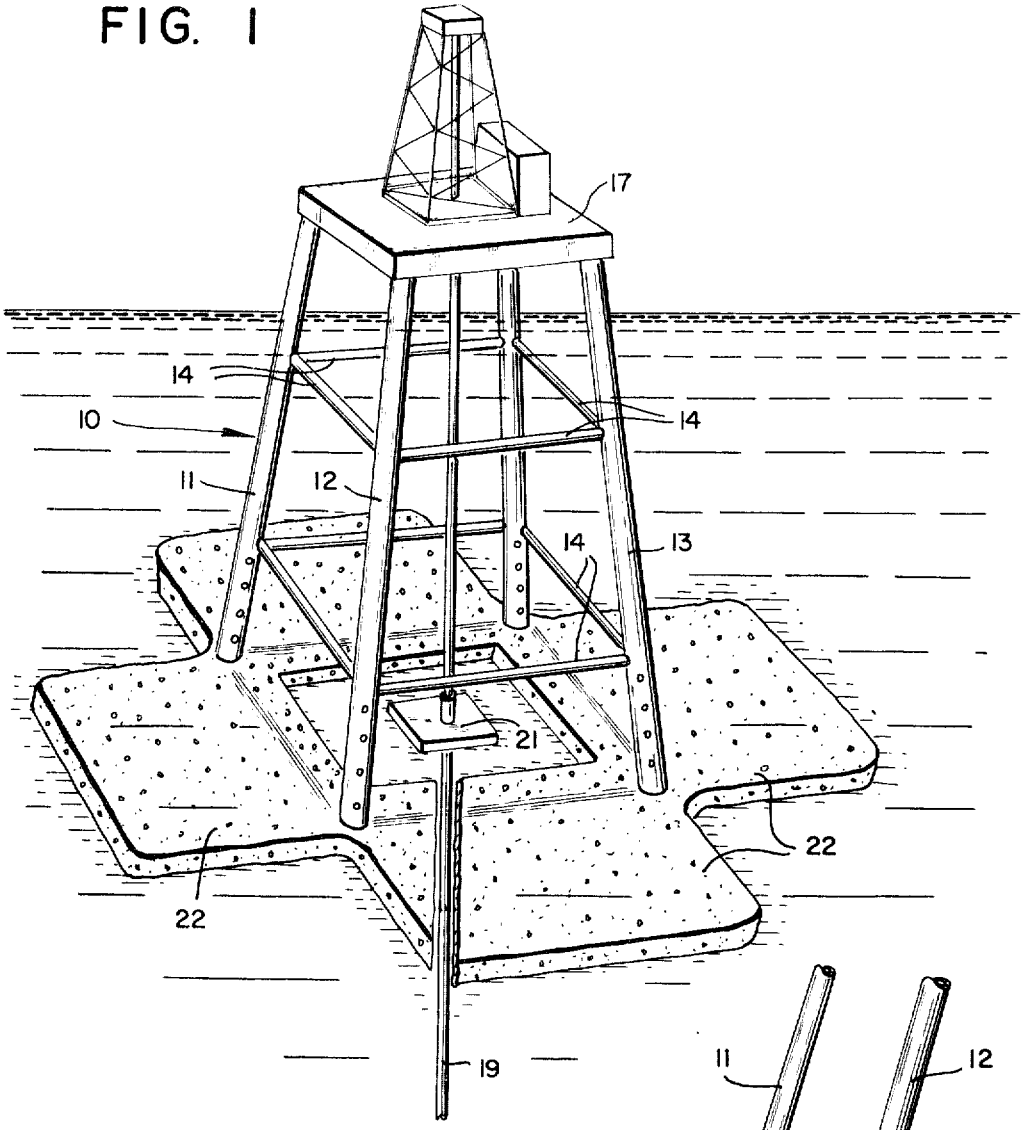
FIG. 1 is a perspective view of a marine platform, as contemplated, shown fastened to the floor of a body of water.
Figure 2:
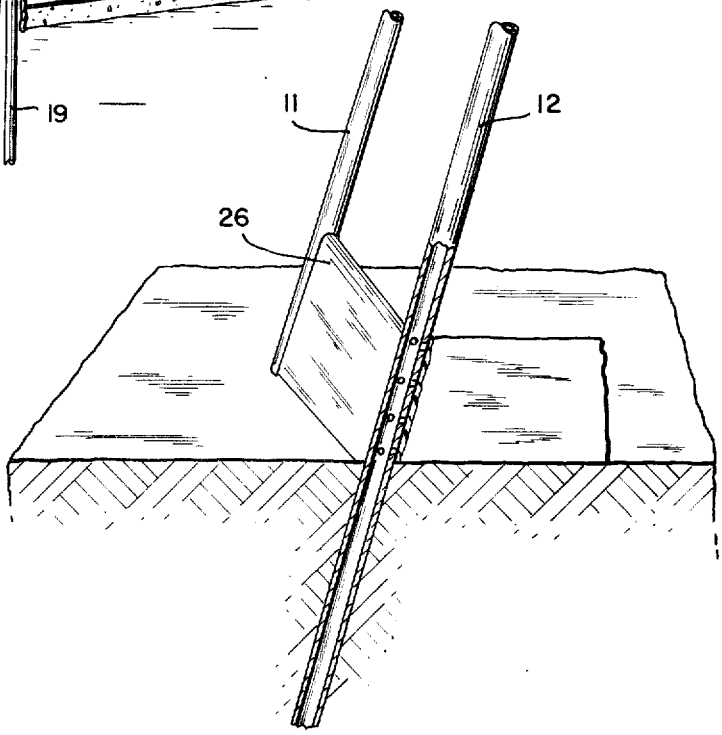
FIG. 2 is an enlarged segmentary view of the lower portion of the structure shown in FIG. 1.

In the normal manner, the respective upstanding support legs or columns are provided with sufficient cross bracing 14 to assure the physical and structural integrity of the unit. For higher platforms and deeper water the amount of structural reinforcing or stabilizing will be understandably greater.

A working deck 17 is normally positioned at the platform upper end, beyond the reach of water and waves. In the instance of a producing facility, deck 17 can contain pumping, separating, and other such equipment for handling crude materials as crude oil or gas. In the instance of a producing platform, deck 17 will be provided with the usual derrick, draw works, crew quarters, and the like to accomplish the desired drilling functions.

In either instance, the lower end of the respective elongated support legs 11, 12 and 13 are normally partially embedded into the substrate to support the weight of the platform itself. It is understandable that for a relatively soft substrate as in the instance of a deltaic location, the platform will tend to sink rather deeply before coming to rest. For a more substantial or consolidated substrate, the platform will tend to rest on the surface of the ocean floor rather than embed itself.

In either instance the firm positioning of the platform is assured by inserting anchoring piles to a predetermined point in the substrate where the stability of the platform is assured. These anchoring piles are normally guidably driven through the respective support legs. Each leg is consequently sufficiently large to accommodate a number of the piles. The depth to which the piles are forced is governed by several factors including the condition of the substrate, the expected weight to be carried by the platform, and the expected forces which will be exerted against it.

Under normal operating circumstances in the instance of a drilling platform a number of wells such as 19 will be drilled from the water's surface, down through the center of the platform and into the substrate. Thus, the interior defined by the lower end of the respective support legs, will be provided with a plurality of well heads such as 21.

In the instance of a storage or processing facility, platform 10 can be provided with a series of flow lines which are brought along the ocean floor and diverted upwardly through the center of the platform, or along the respective legs, to the deck.

In either instance the lower end of platform 10 is provided with a substantially flat apron or spread foundation footing 22 which is connected to and extends outwardly from the platform. In its preferred form, apron 22 comprises a relatively heavy slab or footing which, by virtue of its weight, will be partially embedded into the substrate about the platform to provide a firm foundation and anchor for the latter.

The preferred material of which apron 22 is formed is cement or concrete such that the latter can be initially injected in fluid form and subsequently hardened into a desired shape. This is achieved by introducing the fluidized, hardenable material into flexible walled collapsible containers 23 carried at the platform lower end.

Said containers 23, as shown in FIG. 3 can be initially folded or otherwise compacted into a relatively small unit depending from platform members, prior to the platform being submerged to its subsea position. In such an instance the flexible walled containers 23 are attached to structural members of the platform at the latter's lower end such as cross brace 14. The said flexible walled containers 23 are so designed to permit the heavy, fluidized material to flow in a desired pattern across the sea floor at the platform lower end. Preferably apron 22 will be formed to substantially surround the support legs and the respective piles, which would ordinarily be subjected to the greatest amount of erosion due to water flowing thereabout.

Thus, flexible walled containers 23 are positioned to surround, or at least partially enclose the respective support legs in a manner to direct fluid cement about the legs that would ordinarily be subject to the most severe erosion conditions. As shown in FIGS. 3 and 4 flexible walled member 23 includes a prefabricated bag-like member that is communicated with a source of the fluidized concrete through conduit 24. The latter extends along and is fastened to one or more platform legs 12 to the water's surface, preferably terminating at deck 17 such that fluid concrete can be deposited in the upper end thereof.

The shape or configuration of flexible member 23 is such that as fluidized concrete is introduced thereto it will tend to spread along the lower side of the said member as the heavy concrete assumes its normal horizontal disposition. Thus, the member 23 will be forced open by the weight of the concrete and expand to its fully unfolded position thereby defining at least a partial enclosure for the fluidized material.

A predetermined amount of the latter will thereafter be further introduced to provide the necessary thickness and additional weight required in the platform lower end as well as to provide the desired thickness to the poured apron 22.

Container 23 functions to form a resilient walled partial enclosure which can be subsequently removed or eroded away due to wear, water movement, abrasion and the like. Said member 23 can therefore be formed of a reinforced, basically flexible material such as rubber reinforced canvas or the like. Also reinforced neoprene or other suitable plastic material which can be prefolded and yet be spread by inflowing concrete.

Referring to FIG. 3, container 23 is, as shown, folded into a relatively tight compact body 26. As platform 10 is being transported along the water's surface, said body or pack 26 can further be enclosed within a rigid, temporary closure to prohibit its being prematurely opened as a result of contact with wind or water as the platform is moved.

However, as platform 10 is permitted to controllably submerge to its resting place at the ocean floor, the restraints or other protective members are released from folded pack 26. Thus, the latter will be free to unfold and/or adjust in response to water movement about the platform lower end. Preferably, pack 26 will maintain its shape until the platform is settled on the ocean floor to avoid the flexible members 23 becoming entangled in the platform legs.

Thereafter, with platform 10 positioned as desired, and piled into place, fluidized cement is introduced through conduit 24, the lower end of which terminates within the partial enclosure of said member 23. The continuous flow of the concrete or cement into the enclosure will displace water to completely open the latter, regardless of its initial disposition. Thus, the predetermined amount of concrete will flow outwardly away from the platform base. Eventually, flexible walled member 23 will be stretched to its maximum expanded position thereby permitting the concrete to build up to its desired thickness rather than merely to spread about the floor. The enclosure is thus designed in such manner when in open position to accommodate the set amount of the concrete which will eventually form the desired apron 22.

As shown in FIGS. 4 and 5, a portion of the enclosure within flexible member 23 can be arranged to fall within the periphery of the respective support legs. Thus, the concrete will reach into said area as well as external to the periphery of the base.

Toward facilitating the disposition of the apron 22 an upstanding plate or similar cross member formed of spaced apart bars 27 is disposed about the platform lower end forming a retaining wall for concrete thereby delivering it as required to the inner or the outer base sections.

Since in the instance of most concrete or cement structures a degree of reinforcing is often required, the latter can be provided in the form of a steel mesh wire 28 or the like. Further, said material as shown in FIG. 5 can be initially rolled into such form as to open concurrently with the opening or expansion of the flexible walled member 23 which will enclose not only the subsequently poured cement, but also the reinforcing element. Flexible walled member 23 will thus serve as a retainer for the reinforcing element until such time as both members are released from the platform at its subsea position.

Other modifications and variations of the invention as hereinbefore set forth may be made without departing from the spirit and scope thereof, and therefore, only such limitations should be imposed as are indicated in the appended claims.

We claim:

1. Method for setting a marine structure at an offshore site, said structure having opposed upper and lower ends and a plurality of adjacently positioned support legs depending downwardly therefrom, adapted to be embedded into the floor of a body of water, which method includes the steps of;

providing said marine structure with at least one flexible walled enclosure member supported between at least two of said legs, at a location adjacent to those portions of the structure's lower end which will be embedded into the ocean floor, forming said flexible walled enclosure member into a compact body and applying restraining means to said body to maintain the shape thereof prior to said structure being positioned at a working site on the ocean floor, lowering the said structure whereby to embed the lower end thereof into said floor of said body of water, and introducing a fluidized stream of a hardenable material into said compact body to displace the flexible walls thereof, while said member encloses the fluidized material to confine the latter as it spreads about the ocean floor.

2. In the method as defined in claim 1, including the step of providing the interior of said flexible walled enclosure member with a concrete reinforcing element adapted to be formed into said compact body, said reinforcing element being further capable of assuming a disposition adjacent to the ocean floor whereby to be embedded in concrete when the latter is introduced into said compact body.

* * * * *